United States Patent [19]

Jessick et al.

[11] Patent Number: 4,830,114

[45] **Date of Patent: * May 16, 1989**

[54] SELF-ACTIVATING FIRE EXTINGUISHER

[75] Inventors: Jerry P. Jessick, Newfield; Francis J. Vastano, Vineland; James Jessick, Franklin Township, Gloucester County, all of N.J.

[73] Assignee: Future Fire Suppression, Inc., Newfield, N.J.

[ * ] Notice: The portion of the term of this patent subsequent to Dec. 1, 2004 has been disclaimed.

[21] Appl. No.: 74,899

[22] Filed: Jul. 17, 1987

[51] Int. Cl.[4] ..... A62C 35/02

[52] U.S. Cl. ..... 169/26

[58] Field of Search ..... 169/26, 27, 28, 58

[56] References Cited

U.S. PATENT DOCUMENTS 1,890,541 12/1932 Hawley ..... 169/26
2,857,971 10/1958 Ferris ..... 169/26
3,334,780 8/1967 Van Leer et al. ..... 169/26
4,709,763 12/1987 Jessick ..... 169/26

*Primary Examiner*—Sherman D. Basinger
*Assistant Examiner*—Thomas J. Brahan
*Attorney, Agent, or Firm*—Norman E. Lehrer

[57] ABSTRACT

A self-activating fire extinguisher which is particularly useful as a Christmas tree ornament is comprised of a thin-walled sealed glass container having a quantity of a fire extinguishing liquid such as Halon 2402 contained therein. When in the vicinity of a fire, the temperature of the liquid will rise causing it to boil which increases the pressure within the container. Eventually the container will break, releasing the liquid; the fumes from which extinguish the fire. In order to prevent glass fragments from being thrown about when the container breaks, the majority of the container covered by a metal shell. This shell is adhesively secured to the glass and maintains the broken pieces of glass together even at high temperatures. The liquid and fumes are released through a small portion of the container that is not covered by the shell.

11 Claims, 1 Drawing Sheet

SELF-ACTIVATING FIRE EXTINGUISHER

BACKGROUND OF THE INVENTION

The present invention is directed toward a selfactivating fire extinguisher and more particularly toward such a device which includes a frangible package having a quantity of a fire extinguishing liquid therein which is dispersed when the package breaks at an elevated temperature.

Fire extinguishers have been known in the past which utilize a liquid within a container wherein the container bursts as a result of increased internal pressure created by the heat from a fire in order to release the liquid. Reference is made to such prior extinguishers in U.S. Pat. No. 2,857,971. While the details of such devices are not known, it is assumed that a protective cover or the like must be provided around the container in order to prevent injuries when the container explodes. Providing such covers would, undoubtedly, increase the cost of such extinguishers.

The foregoing problem becomes even more serious when it is desired to use the more modern fire extinguishing fluids which are currently available such as Halon. It is known that these materials must be contained in an airtight container in order to preserve the effectiveness thereof. Since fire extinguishers must sometimes be kept many years before the fluid is utilized, it has been determined that the best type of container for these materials is glass. Should such an extinguisher explode, however, the flying glass can create a serious danger.

Prior U.S. Pat. Nos. 3,843,525 and 3,918,526 shown an example of a fire extinguisher which includes a glass cylinder which is filled with a fire extinguishing solution. Although the cylinder is provided with a cover, the cover is apparently made of a combustible plastic. According to the patent, the container bursts into small pieces as a direct result of the heat created by the burning cover. Thus, the cover does not provide protection for the fragments of broken glass.

While the present invention has many uses, it is particularly suited for the manufacture of self-activating fire extinguishers which can also function as Christmas tree ornaments. In connection with such use, it is important that glass fragments not be thrown about when the extinguisher is activated. To Applicant's knowledge, no one has ever proposed to utilize an exploding-type fire extinguisher as an ornament for a Christmas tree.

Insofar as Applicant is aware, only one proposal has been made in the past to combine a fire extinguisher with a Christmas tree ornament. This combination is shown in U.S. Pat. No. 2,522,020. However, the device shown in this patent is relatively complex and utilizes a mechanical actuator to release the fire extinguishing liquid from the ornament. The ornament does not break as a result of the ornament or the fluid contained therein being heated.

SUMMARY OF THE INVENTION

The present invention is designed to overcome all of the deficiencies of the prior art discussed above. The self-activating fire extinguisher of the present invention is particularly useful as a Christmas tree ornament or the like and is comprised of a thin-walled sealed glass container having a quantity of a fire extinguishing liquid such as Halon 2402 contained therein. When in the vicinity of a fire, the temperature of the liquid will rise causing it to boil which increases the pressure within the container. Eventually the container will break, releasing the liquid; the fumes from which extinguish the fire. In order to prevent glass fragments from being thrown about when the container breaks, the majority of the container is covered with a metal shell. This shell is adhesively secured to the glass and maintains the broken pieces of glass together even at high temperatures. The liquid and fumes are released through a small portion of the container that is not covered by the metal.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
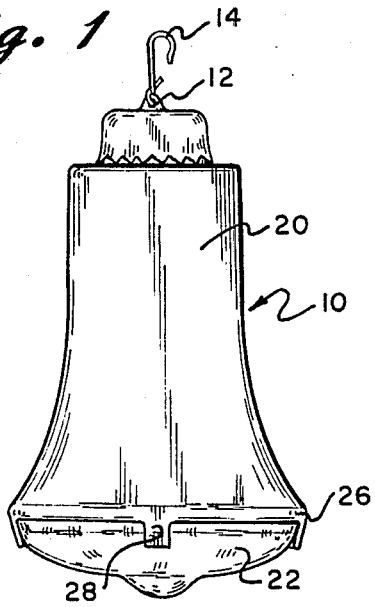
FIG. 1 is a self-activating fire extinguisher in the form of a Christmas tree ornament constructed in accordance with the principles of the present invention.
Figure 5:
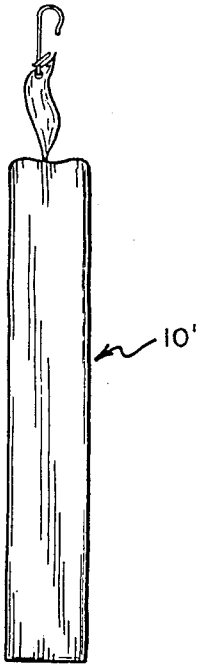
FIG. 5 is a perspective view of another alternate embodiment of the device shown in FIG. 1.

Referring now to the drawings in detail wherein like numerals have been used throughout the various figures to designate like elements, there is shown in FIG. 1 a self-activating fire extinguisher constructed in accordance with the principles of the present invention and designated generally as 10. Because of the construction of the present invention, it is particularly well suited to be used as an ornament for a Christmas tree. It is well known that many house fires are started by Christmas trees catching on fire. A plurality of fire extinguishers 10 hanging on a Christmas tree can extinguish the fire before it spreads. It is for this reason, that the extinguisher 10 shown in FIG. 1 is made in the shape of a bell. This is, of course, by way of example only since the device can also be made in various other shapes such as the candle 10' shown in FIG. 5 or in substantially any other ornamental shape. As should be readily apparent to those skilled in the art, the extinguisher of the present invention need not be limited to a Christmas tree ornament but may take various other shapes and have various other uses.

The bell-shaped fire extinguisher 10 has an upper portion with an opening 12 to which a wire hook 14 is attached for suspending the extinguisher from a support such as a Christmas tree. As shown most clearly in FIG. 2, the extinguisher 10 is comprised essentially of a thin-walled glass container 16 which is totally closed and sealed from the outside atmosphere. A quantity of a fire extinguishing liquid 18 is within the container 16. Preferably the container will be approximately three-quarters filled with the liquid 18.

The preferred fire extinguishing liquid 18 is Halon 2402 which is available through Montedison USA, Inc. of New York, N.Y.; the chemical composition of which, according to the supplier, is 1.2 dibromo-1.1.2.2. tetrafluoroethane. Halon 2402 has a relatively low boiling point of approximately 47.3° C. When converted into a gaseous state, the fumes are denser than air whereby they tend to settle downwardly and are capable of extinguishing a fire from the source thereof by displacing oxygen.

Figure 2:
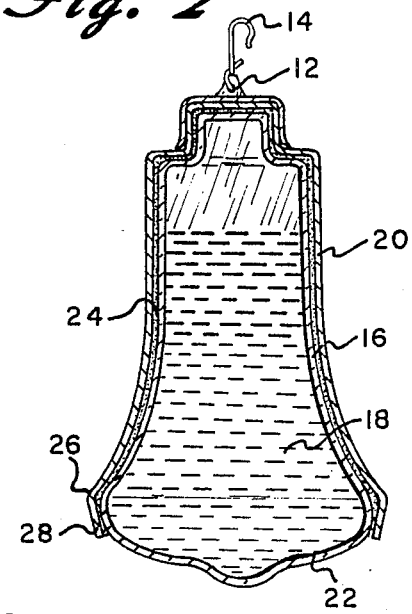
FIG. 2 is a cross-sectional view of FIG. 1.
Figure 3:
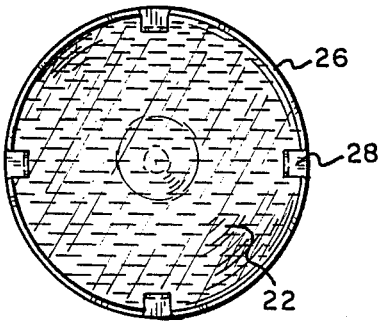
FIG. 3 is a bottom view of the extinguisher shown in FIGS. 1 and 2.

A thin but substantially self supporting shell 20 is secured to the outer surface of the glass container 16. The shell 20 has a shape which is substantially complementary to the container 16. Preferably, however, the bottom portion 22 of the container 16 is not covered by the shell 20. The shell 20 is secured to the glass container 16 through the use of a high temperature adhesive 24 which lies between the outer surface of the container 16 and the inner surface of the shell 20. In addition to the adhesive 24 or in lieu thereof, the lower edge 26 of the shell 20 may be provided with a plurality of tabs 28 which can be bent inwardly as shown in FIGS. 1 and 2 so as to grip the lower section of the glass container 16. The tabs 28 are, of course, by way of example only since it is possible to provide the lower edge 26 of the shell 20 with various other shapes such as a scalloped edge which can be bent. In addition, it is also possible to provide the lower portion 26 with a straight continuous edge and wherein the entire edge is crimped in order to grip the peripheral edge of the lower portion 22 of the container 16.

The shell 20 is preferably made from sheet metal or the like so that it will be capable of substantially maintaining its shape and physical characteristics at an elevated temperature and particularly at a temperature above the boiling point of the liquid 18. However, high temperature plastics or other materials having similar characteristics could also be utilized.

Because the shell 20 adds structural strength to the upper portion of the glass container 16, the lower portion 22 of the container 16 will tend to break and blow out as the temperature of the liquid 18 increases. It may also be desirable to weaken the glass wall of the container in a portion of the section 22 by grinding or sanding in order to make that portion more frangible than the remaining portions of the container. This could also be done by a thin score line which can be circular or substantially any other configuration. This more frangible portion will ensure that the glass container breaks at that portion.

The self-activating fire extinguisher 10 functions in the following manner. The device 10 is suspended from a support such as a Christmas tree or the like utilizing the hook 14. In the event of a fire, the temperature of the liquid 18 rises and the same begins to boil thereby increasing the pressure within the container. Eventually the pressure within the container becomes great enough to cause at least a portion of the glass container 16 to shatter. Since the portion 22 is not supported by the shell 22 and/or is more frangible than the remaining portions of the glass container, this portion will shatter first. In the event that the remaining portions of the glass container 16 shatter, however, the shell 20 will retain the glass fragments in place. The liquid and fumes from within the container 16 will escape substantially only through the opening caused by the breaking of the portion 22. The fumes will settle downwardly over the tree towards the floor and will extinguish the fire causing the heat.

Figure 4:
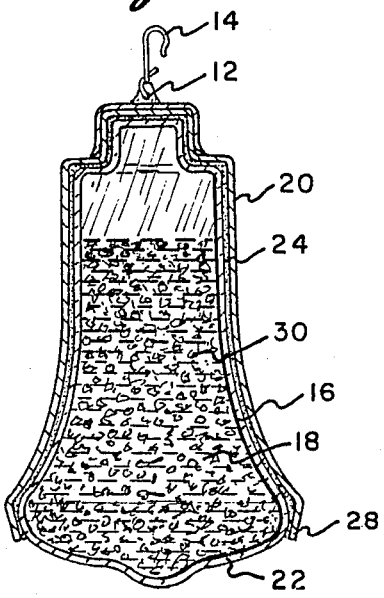
FIG. 4 is a view similar to FIG. 2 showing an alternate embodiment thereof.

In the embodiment of the invention shown in FIG. 4, particulate matter such as gas cracklings or other absorbent material 30 may also be included within the container 16. The particulate matter 30 will absorb a substantial portion of the liquid 18. When the glass container 16 breaks as a result of a fire, the particulate matter 30 carrying the liquid 18 will fall from the container and will tend to adhere to different parts of the Christmas tree as the particles fall. The fumes will then be released from the particulate matter thereby more broadly and evenly spreading the fumes in order to extinguish the fire.

The present invention may be embodied in other specific forms without departing from the spirit or essential attributes thereof and accordingly reference should be made to the appended claims rather than to the foregoing specification as indicating the scope of the invention.

We claim:

1. A self-activating fire extinguisher comprising:

a glass container, said container being totally closed and sealed from the outside atmosphere;

a quantity of a fire extinguishing liquid within said container, said liquid having a relatively low boiling point and, when converted into a gaseous state, having fumes which are denser than air whereby said fumes tend to settle downwardly and are capable of extinguishing a fire;

a thin shell covering a substantial portion of the outer surface of said glass container and being secured thereto, said shell being capable of substantially maintaining its shape and physical characteristics at a temperature above the boiling point of said liquid and above the temperature which is needed for the boiling liquid in said container to cause said container to shatter;

at least one portion of the outer surface of said glass container not being covered by said shell;

whereby, in the event of a fire, the temperature of the liquid within said container rises and the same begins to boil thereby increasing the pressure within the container until at least a portion of the glass shatters, said shell substantially maintaining the shape of said container so that said liquid and the fumes therefrom escape substantially only at that portion of the glass container which is not covered by said shell.

2. The invention as claimed in claim 1 wherein that portion of the container not covered by said shell is more frangible than the remaining parts of said container.

3. The invention as claimed in claim 2 wherein the thickness of said glass is less at said portion than at the remaining parts of said container.

4. The invention as claimed in claim 1 wherein said liquid has a boiling point below approximately 65° C.

5. The invention as claimed in claim 1 further including a quantity of particulate matter within said container capable of absorbing at least a portion of said liquid.

6. The invention as claimed in claim 1 wherein said shell is comprised of metal.

7. The invention as claimed in claim 1 further including means connected to said container for suspending the same from a support.

8. The invention as claimed in claim 7 wherein said container is in the shape of a Christmas tree ornament.

9. The invention as claimed in claim 8 wherein said container is in the shape of a bell.

10. The invention as claimed in claim 1 wherein said shell is adhesively secured to said container.

11. The invention as claimed in claim 1 wherein said shell is secured to said container by a portion of said shell being bent to grip a section of said container.

* * * * *